US005288577A

United States Patent [19]

Yamaguchi et al.

[11] Patent Number: 5,288,577

[45] Date of Patent: Feb. 22, 1994

[54] DRY-TYPE DEVELOPER

[75] Inventors: Kimitoshi Yamaguchi, Numazu; Yoichiro Watanabe, Fuji, both of Japan

[73] Assignee: Ricoh Company, Ltd., Tokyo, Japan

[21] Appl. No.: 841,830

[22] Filed: Feb. 26, 1992

[30] Foreign Application Priority Data

Feb. 27, 1991 [JP] Japan ..... 3-53625

[51] Int. Cl.[5] ..... G03G 9/09; G03G 9/107; G03G 9/113

[52] U.S. Cl. ..... 430/106.6; 430/108; 430/111

[58] Field of Search ..... 430/106.6, 108, 161

[56] References Cited

U.S. PATENT DOCUMENTS 4,357,406 11/1982 Kouchi et al. ..... 430/137
4,810,611 3/1989 Ziolo et al. ..... 430/108
4,912,005 3/1990 Goodman et al. ..... 430/108

FOREIGN PATENT DOCUMENTS 260254 11/1986 Japan ..... 430/108
35561 2/1989 Japan ..... 430/108
37366 2/1990 Japan ..... 430/108
187771 7/1990 Japan ..... 430/108
264268 10/1990 Japan ..... 430/108

*Primary Examiner*—Roland Martin
*Attorney, Agent, or Firm*—Cooper & Dunham

[57] ABSTRACT

A dry type developer is composed of substantially spherical, electrically insulating toner particles which are free from electroconductive particles, and carrier particles, each carrier particle including a core particle and a resin layer coated on the surface of the core particle, with a resistivity in the range of $10^8$ to $10^{14}$ Ωcm under application of a DC voltage of 1000 volts.

15 Claims, 1 Drawing Sheet

DRY-TYPE DEVELOPER

FIELD OF THE INVENTION

The present invention relates to a dry-type developer for electrophotography, comprising substantially spherical, electrically insulating toner particles free from electroconductive particles, and carrier particles, each carrier particle comprising a core particle and a resin layer coated on the surface of the core particle, with a resistivity in the range of $10^8$ to $10^{14}$ Ωcm under application of a DC voltage of 1000 volts.

DISCUSSION OF THE BACKGROUND

Developers for use in electrophotography are required to comprise toner particles having a small average particle size with a sharp particle size distribution, and have satisfactory coloring performance and uniform chargeability, in order to obtain high quality images and excellent developer durability when used in an electrophotographic system.

The image formation characteristics, such as resolution, sharpness, half-tone reproduction and photographic reproduction of images, can be improved by reducing the average particle size of the toner particles in a developer. Furthermore, when the average particle size of toner particles is reduced, the half-tone reproduction and the photographic reproduction, in particular, are improved. In addition, when the toner particles have a small average particle size, the particle size distribution of the toner particles does not change even when the developer is used for an extended period of time. Therefore, the obtained image quality is stabilized and the life of the developer can be prolonged.

Conventionally, toner particles are generally produced by mixing a resin, a dye or a pigment, and a charge control agent, then fusing and kneading the mixture, mechanically crushing the kneaded mixture after cooling to produce toner particles, and classifying the resulting toner particles. The toner particles obtained by the above-mentioned conventional method have the following shortcomings when the particle size of the toner particles is reduced:

(1) As the particle size of the toner particles is reduced, the chargeability of the toner particles is decreased because of the non-uniform dispersion of the charge control agent in the toner particles, and the toner particles tend to be deposited on the background area of a copy paper, and to be scattered.

(2) The toner particle obtained by the above-mentioned crushing process has a very rough surface and many protrusions on the surface, so that the components of the toner particle are easily detached from the surface thereof As a result, a so-called toner filming phenomenon occurs, in which the toner particles are deposited in the form of a film on the surfaces of the carrier particles, a triboelectric charging member and a photoconductor employed in a photographic copying system (3) The coloring performance of the toner particles is decreased when the particle size of the toner particles is reduced.

(4) It becomes difficult to remove the small-particle-size toner particles from the surface of the photoconductor when the photoconductor is cleaned.

(5) The productivity and yield of the small-particle-size toner particles are significantly low. In particular, when toner particles with a sharp particle size distribution are obtained, the productivity and yield thereof are considerably decreased and the cost of such toner particles is high. Also, there is a limitation on the reduction of the particle size distribution even when the classification is repeated.

Accordingly, many proposals have been made concerning the production of toner particles having small particle sizes and a narrow particle size distribution which are capable of yielding high image quality and which have high durability.

For example, a method of producing core resin particles including a pigment and a charge control agent therein by a suspension polymerization method is proposed as disclosed in Japanese Patent Publications 51-14895 and 47-51830. However, with this method, it is difficult to remove a polymer-dispersion stabilizing agent and a surface active agent remaining on the surface of toner particles. These agents often cause the deterioration of the chargeability of the toner particles, and the properties of the toner particles obtained by this method are easily changed depending upon the ambient conditions.

Moreover, it is difficult to stably produce toner particles having small particle sizes with a narrow particle size distribution.

Methods of producing toner particles having small particle sizes and a narrow particle size distribution with a so-called core-shell structure are proposed as disclosed in, for example, Japanese Laid-Open Patent Applications 58-106554, 61-18965, and 61-275766. According to these methods, a coloring agent and materials capable of imparting properties necessary for a toner for use in electrophotography are deposited and coated on the surface of particles with a narrow particle size distribution. The toner particles obtained by these methods, however, have very poor electric characteristics and durability because of the presence of the above coloring agent and materials on the surface of the toner particles.

Furthermore, methods of producing toner particles by dyeing resin particles by immersing the particles in a solution of a dye are disclosed in, for example, Japanese Laid-Open Patent Applications 50-46333, 1-103631, 56-154738, 61-228458, 63-106667, and 64-90454.

The methods disclosed in these Japanese Laid-Open Patent Applications appear suitable for producing toner particles with a narrow particle size distribution because of the small number of production steps. However, those methods have not yet been studied to the extent that it can be confirmed that each of the toner particles obtained is uniformly dyed to the inside thereof. Moreover the descriptions in these Japanese Laid-Open Patent Applications are insufficient for actual preparation of the toner particles.

Japanese Laid-Open Patent Application 61-228458 discloses a method of producing toner particles by dyeing resin particles prepared by dispersion polymerization, with a dispersion stabilizer permanently deposited on the surface of the toner particles. The toner particles produced by this method, however, have the shortcoming that the triboelectric chargeability thereof is unstable because the polarity of the toner particles is controlled by the dispersion stabilizing agent deposited on the surface of the toner particles.

Toner particles free from the above-mentioned shortcomings are proposed in U.S. patent application Ser. No. 596474 filed Oct. 12, 1990 by Suguro et al. These toner particles are prepared by dyeing polymer particles obtained by polymerization in a hydrophilic organic solvent and have a narrow particle size distribution. A developer comprising the above toner particles is capable of providing images with high image density and high resolution, free from toner deposition on the background of the images, and can be used for an extended period of time with high reliability, without causing significant changes in the image quality obtained and the properties of the developer However, in the case of a developer which is prepared by mixing such toner particles with resin-coated carrier particles which are widely used for prolonging the life of developers and preventing the deposition of carrier particles on solid image areas, the developer has the defect that non-developed portions tend to be produced at the rear edge of a half-tone portion of the obtained image.

SUMMARY OF THE INVENTION

It is therefore an object of the present invention to provide a developer which comprises carrier particles and toner particles having small particle sizes with a small particle size distribution, is capable of providing high image resolution, high image sharpness, high half-tone reproduction and photographic reproduction, and has excellent coloring performance, free from problems such as the formation of non-developed areas at the rear edge of the half-tone portion of the obtained image, thereby having high reliability in image formation.

This object of the present invention can be achieved by a dry type developer comprising (a) substantially spherical, electrically insulating toner particles which are free from electroconductive particles, and (b) carrier particles, each carrier particle comprising a core particle and a resin layer coated on the surface of the core particle, with a resistivity in the range of $10^8$ to $10^{14}$ Ωcm under application of a DC voltage of 1000 volts.

DETAILED DESCRIPTION OF THE PREFERRED EMBODIMENTS

Figure 1:
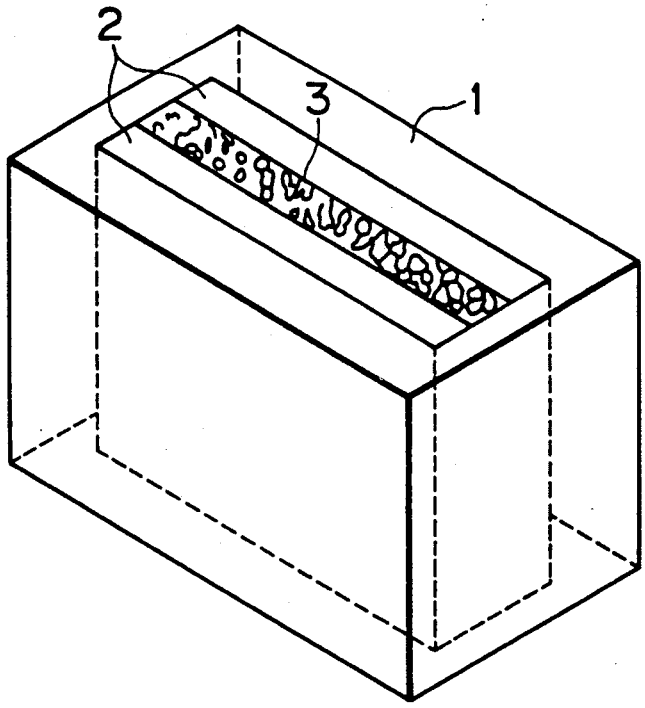
FIG. 1 is a perspective view of a device for the measurement of the resistivity of the resin-coated carrier particles contained in a dry-type developer according to the present invention.

The dry type developer according to the present invention comprises (a) substantially spherical, electrically insulating toner particles which are free from electroconductive particles, and (b) carrier particles, each carrier particle comprising a core particle and a resin layer coated on the surface of the core particle, with a resistivity in the range of $10^8$ to $10^{14}$ Ωcm under application of a DC voltage of 1000 volts. It is preferable that the resistivity of the carrier particles be in the range of $10^{10}$ to $10^{13}$ Ωcm, in order to attain the object of the present invention. The resistivity of the carrier particles for use in the present invention is measured by a resistivity measurement device as shown in FIG. 1.

The device shown in the figure is composed of a container 1 made of a fluorine plastic, and a pair of electrodes 2, 2, with an area of 20 $cm^2$ (5 cm×4 cm), disposed so as to face one other, with a space of 2 mm therebetween, to constitute a cell, placed in the container 1.

The electric resistivity of the resin-coated carrier particles is measured in accordance with the following steps: (1) filling a sample of carrier particles 3 into the cell to the brim; (2) placing a load of 500 g on the sample for 1 minute; (3) removing an excessive portion of the sample 3 using, for instance, a plastic plate, to make the outer surface of the sample 3 smooth; (4) applying a DC voltage of 1000 V for one minute; (5) measuring the electric resistivity of the sample 3; and (6) correcting the measured value with the area of the electrode (×100), thereby calculating the electric resistivity of the sample of the carrier particles 3.

The resin coated carrier particles employed in the dry type developer according to the present invention have an electric resistivity in the range of $10^8$ to $10^{14}$ Ωcm as described before. When the resistivity of the carrier particles sis less than $10^8$ Ωcm, the toner deposition on the background of the images, the toner filming phenomenon, and the carrier-spent phenomenon occur. When the resistivity of the carrier particles exceeds $10^{14}$ Ωcm, non-developed portions are formed in the rear edge portion of half-tone image areas. Moreover, the electric resistivity of the resin-coated carrier particles can be controlled within the above range by adjusting the thickness of the coated resin layer of the carrier particles or by adjusting the amount of an electroconductive material to be contained in the coated resin layer.

Examples of the resin used for the resin layer of the carrier particles include: polyolefin resins such as polyethylene, polypropyrene, chlorinated polyethylene, and chlorosulfonated polyethylene; polyvinyl resins and polyvinylidene resins such as polystyrene, acrylic resins (for instance, polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; vinyl chloride - vinyl acetate copolymers; styrene - acrylic acid copolymers; silicone resins such as a straight silicone resin comprising an organosiloxane bond, and modified silicone resins thereof (for instance, silicone resins modified by alkyd resin, polyester, epoxy resin, and polyurethane); fluorocarbon resins such as polytetrafluoroethylene, polyvinyl fluoride, polyvinylidene fluoride, and polychlorotrifluoroethylene; polyamide; polyester such as polyethylene terephthalate; polyurethane; polycarbonate; amino resins such as urea - formaldehyde resins; and epoxy resins.

Of the above resins, acrylic resins, silicone resins, modified-silicone resins, and fluorocarbon resins are preferable, and silicone resins and modified-silicone resins are most preferable to prevent the adhesion of spent toner particles to the carrier particles.

Specific examples of commercially available straight silicone resins are "KR271", "KR255" and "KR251" (made by Shin-Etsu Chemical Co., Ltd.); and "SR2400" and "SR2406" (made by Dow Corning Toray Silicone Co., Ltd.).

Specific examples of commercially available modified-silicone resins are alkyd-resin-modified silicone resins such as "KR206" (made by Shin-Etsu Chemical Co., Ltd.) and "SR2110" (made by Dow Corning Toray Silicone Co., Ltd.); and acrylic-resin-modified silicone resins such as "KR3093" (made by Shin-Etsu Chemical Co., Ltd.); and epoxy-resin-modified silicone resins such as "ES1001N" (made by Shin-Etsu Chemical Co., Ltd.) and "SR2115" (made by Dow Corning Toray Silicone Co., Ltd.).

Examples of the core material of the carrier particles are magnetic materials such as $Fe_2O_3$, $\gamma$-$Fe_2O_3$, $Fe_3O_4$, MnZn ferrite, NiZn ferrite, Ba ferrite, Fe, Ni, Co, and alloys thereof; and glass beads in the form of particles with a diameter of about 10 to 300 μm.

A variety of materials such as metals, metal alloys, metallic oxides and carbon black can be employed as electroconductive materials which may be used in the resin layer coated on the carrier particles.

Specific examples of commercially available electroconductive materials for use in the resin layer of the carrier particles include: $TiO_2$-based materials such as "ECT-52", "KV400", "ECR-72",and "ECTR-82" (made by Titan Kogyo K.K.), "500W", "300W", and "S-1" (made by Ishihara Sangyo Kaisha, Ltd.), and "W-10" made by Mitsubishi Metal Corporation); $SnO_2$-based materials such as "W-1" (made by Mitsubishi Metal Corporation), "MEC300", and "MEC500" (made by Teikoku Kakou Co., Ltd.); ZnO such as "23K" (made by Hakusui Chemical Industries), "Electroconductive Zinc Flower No. 1", and "Electroconductive Zinc Flower No. 2" (made by The Honjo Chemical Industries); electroconductive textiles such as "Dentall WK-100", "Dentall WK-200", and "Dentall WK-300" (made by Ohtsuka Chemical Co., Ltd.); and carbon particles such as "Black Pearls 2000", and "VULCANXC-72" (made by Cabot Corporation), "Ketjen Black EC.DJ500", and "Ketjen Black EC.DJ600" [made by Lion Akzo Co., Ltd.); particles and finely-divided particles of "Denka black" (made by Denki Kagaku Kogyo K.K.); "Conductex 975", and "Conductex SC" (made by Columbian Carbon Ltd.) and "Carbon Black #44" (made by Mitsubishi Kasei Corporation).

The carrier particles, each carrier particle comprising a core particle and a resin coated layer on the surface of the core particle, for use in the present invention can be prepared by coating the core particle with the resin or a resin solution or dispersion containing any of the abovementioned electroconductive materials by immersion coating or spray coating to an appropriate thickness.

As a solvent for such coating, the following materials can be employed: water, methyl alcohol, ethyl alcohol, isopropyl alcohol, methyl acetate, ethyl acetate, butyl cellosolve, toluene, hexane, octane, petroleum ether, benzene, xylene, carbon tetrachloride, tetrahydrofuran, and methyl ethyl ketone.

The electric resistivity of the carrier particles can be changed by changing the thickness of the resin layer coated on the core particles or by dispersing an electroconductive material in the coating materials for the resin layer.

In the former method, when the resin layer is made extremely thin in order to reduce the electric resistivity of the carrier particles, there are the risks that the resin layer is peeled away from the core particles or scraped while in use for an extended period of time, depending upon the kind of resin employed in the resin layer. The thickness of the resin layer can be adjusted by changing the amount of coating liquid for the resin layer or the concentration of the solid components contained in the coating liquid.

By contrast, the latter method is more suitable than the former method for changing the electric resistivity of the carrier particles not only to a large extent, but also in a continuous manner, because the electric resistivity of the carrier particles can be changed by changing the amount of the electroconductive material to be contained in the resin layer. When such electroconductive materials are employed, it is necessary to sufficiently disperse the materials in the coating liquid prior to the coating process. For the dispersion of such electroconductive materials in the coating liquid, mixers such as a ball mill and "T.K. Homomixer" (made by Tokushu Kika Kogyo Co., Ltd.), and a sand mill can be employed.

It is preferable that the toner particles have a volume mean diameter Dv and a particle number mean diameter Dp which satisfy the relationship of $1.00 \leqq Dv/Dp = 1.20$. It is more preferable that the Dv be in the range of 1 μm to 10 μm in the above relationship.

The toner particles for use in the developer according to the present invention are prepared as follows:

Polymer particles are prepared by a dispersion polymerization which is conducted by adding at least one vinyl monomer to a hydrophilic organic solvent, in which the vinyl monomer is soluble, but the polymer particles swell or are substantially insoluble, with addition thereto of a polymerdispersion stabilizing agent which is soluble in the hydrophilic organic solvent. The thus prepared polymer particles can be used as the toner particles for use in the developer according to the present invention.

Alternatively, the above polymerization can be promoted by use of seed polymer particles having smaller particle sizes with a sharper particle size distribution than the polymer particles to be produced to conduct a growth reaction for the formation of the polymer particles in the above polymerization system.

The monomers for preparing the seed polymer particles may be the same as or different from those for the polymer particles for use as the toner particles. However the seed polymer particles may not be soluble in the hydrophilic organic solvent.

It is preferable that the above polymer particles be provided in the form of dyed resin particles uniformly dyed from the surface through the inside thereof when used as the toner particles. Such dyed resin particles can be prepared by dyeing the above-mentioned polymer particles with a dye by dispersing the polymer particles in an organic solvent in which the polymer particles are insoluble.

Examples of the hydrophilic organic solvent employed as the diluent for the monomers either for the seed polymer particles or for the polymer particles for use as the toner particles are as follows: alcohols such as methyl alcohol, ethyl alcohol, modified ethyl alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, cyclohexanol, furfuryl alcohol, tetrahydrofurfuryl alcohol, ethylene glycol, glycerin, and diethylene glycol; and ether alcohols such as methyl cellosolve, cellosolve, isopropyl cellosolve, butyl cellosolve, ethylene glycol monomethyl ether, ethylene glycol monoethyl ether, diethylene glycol monomethyl ether, and diethylene glycol monoethyl ether.

These organic solvents can be used alone or in combination. Further, it is possible to use the above alcohol or ether alcohols in combination with other organic solvents, thereby providing the conditions under which the polymerization conditions are changed, with the formed polymer particles being made insoluble in the mixed solvent, and the particle size of the formed polymer particles, the aggregation of the seed polymer particles, and the formation of new particles are controlled, as the solubility parameters of the formed polymer particles, the so-called SP values thereof, are changed.

Examples of the above-mentioned organic solvent which can be used in combination with the alcohol or ether alcohol are as follows: hydrocarbons such as hexane, octane, petroleum ether, cyclohexane, benzene, toluene, and xylene; halogenated hydrocarbons such as carbon tetrachloride, trichloroethylene and tetrabromoethane; ethers such as ethyl ether, dimethyl glycol, trioxane, and tetrahydrofuran; acetals such as methylal, and diethyl acetal; ketones such as acetone, methyl ethyl ketone, methyl isobutyl ketone, and cyclohexane; esters such as butyl formate, butyl acetate, ethyl propionate, and cellosolve acetate; acids such as formic acid, acetic acid, and propionic acid; sulfur-containing organic compounds and nitrogen-containing organic compounds such as nitropropene, nitrobenzene, dimethylamine, monoethanolamine, pyridine, dimethyl sulfoxide, and dimethylformamide; and water.

The above-mentioned polymerization can be performed in a solvent comprising the above-mentioned hydrophilic organic solvent as the main component, in the presence of an inorganic ion, such as $S_4^{2-}$, $NO_2^-$, $PO_4^{3-}$, $Cl^-$, $Na^+$, $K^+$, $Mg^{2+}$, or $Ca^{2+}$.

Furthermore, the average particle size, particle size distribution and drying conditions of the polymer particles to be obtained can be adjusted by changing the kind and the formulation of the mixed solvent at the initialization of the polymerization, during the polymerization step, and at the termination of the polymerization.

Examples of the polymer-dispersion stabilizing agents which are used when preparing the seed polymer particles or the polymer particles which are grown during the polymerization include: acids and acid derivatives such as acrylic acid, methacrylic acid, o-cyanoacrylic acid, α-cyanomethacrylic acid, itaconic acid, crotonic acid, fumaric acid, maleic acid and maleic anhydride; hydroxyl-group-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerol monoacrylic acid ester, glycerol monomethacrylic acid ester, N-methylol acrylamide, and N-methylol methacrylamide; vinyl alcohols and ethers derived from vinyl alcohols such as vinyl methyl ether, vinyl ethyl ether, and vinyl propyl ether; esters obtained from vinyl alcohols and compounds having carboxyl groups such as vinyl acetate, vinyl propionate, and vinyl butyrate; amides such as acrylamide, methacrylamide, and diacetone acrylamide; acid chlorides such as acrylic acid chloride, and methacrylic acid chloride; homopolymers and copolymers of compounds containing nitrogen atoms or a nitrogen-containing heterocyclic ring such as vinyl pyridine, vinylpyrrolidone, vinyl imidazole, and ethylene imine; polyoxyethylene compounds such as polyoxyethylene, polyoxypropylene, polyoxyethylene alkylamine, polyoxypropylene alkylamine, polyoxyethylene alkylamide, polyoxypropylene alkylamide, polyoxylene nonyl phenyl ether, polyoxyethylene lauryl phenyl ether, and polyoxyethylene stearly phenyl ether; cellulose derivatives such as methyl cellulose, hydroxyethyl cellulose, and hydroxypropyl cellulose; copolymers of the above-mentioned hydrophilic monomers and hydrophobic monomers, for example, styrene, or styrene derivatives such as α-methylstyrene, vinyl toluene, acrylonitrile, and methacrylonitrile.

Further, a crosslinking monomer such as ethylene glycol dimethacrylate, diethylene glycol dimethacrylate, methacrylic acid allyl, or divinylbenzene can also be employed in the above-mentioned polymer or copolymer to produce a crosslinked copolymer.

An appropriate polymer-dispersion stabilizing agent is selected from the above agents, depending on the combination with the hydrophilic organic solvent to be employed and the kind of particles to be obtained, that is, seed polymer particles or polymer particles. A polymer-dispersion stabilizing agent having a strong affinity for the surface of the polymer particles and high absorption properties thereto, and also having a strong affinity for the hydrophilic organic solvent and excellent solubility therein is particularly preferable when preventing the steric aggregation of the polymer particles.

Copolymers having a molecular chain with a certain length, preferably copolymers having a molecular chain with a molecular weight of 10,000 or more, are employed to increase the steric repulsion between the polymer particles. However, when the molecular weight is too large, the viscosity of the liquid containing such a copolymer eminently increases, so that it is difficult to agitate and its operational properties are poor and the properties of the formed polymer particles tend to vary because of the variation of the formation of the polymer particles.

Moreover, the presence of any of the above monomers used as the polymer-dispersion stabilizing agent together with the monomer from which the desired polymer particles are to be prepared is also effective for attaining the stabilization of the polymer particles.

The following materials can be used in combination with the above-mentioned polymer-dispersion stabilizing agents to improve the stability of the polymerized obtained and to narrow the particle size distribution thereof: finely-divided particles of metals such as cobalt, iron, nickel, aluminum, copper, tin, lead, magnesium, and alloys thereof (preferably having a particle size of 1 μm or less), and inorganic compounds, for example, oxides such as iron oxide, copper oxide, nickel oxide, zinc oxide, titanium oxide, and silicon oxide; anionic surface active agents such as higher alcohol phosphate, alkyl benzene sulfonate, α-olefin sulfonate, and phosphoric acid ester; catonic surface active agents, for example, amine salts such as alkylamine salt, amino alcohol aliphatic acid derivatives, polyamine aliphatic acid derivatives, and imidazoline, and heterocyclic quaternary ammonium salts such as alkyl trimethyl ammonium salt, dialkyl dimethy ammonium salt, alkyl dimethy benzyl ammonium salt, pyridium salt, and alkyl isoquinolinum salt; nonionic surface active agents, for example, fatty acid amide derivatives and polyhydric alcohol derivatives; and ampholytic surface active agents, for example, amino acid type surface active agents such as dodecyldi(aminoethyl) glycine and di(octyl aminoethyl)-glycine, and betaine-type surface active agents.

It is preferable that the amount of the polymerdispersion stabilizing agent, when producing seed polymer particles, generally, be in the range of 0.1 to 10 wt. %, more preferably in the range of 1.0 to 5.0 wt. %, to the amount of the hydrophilic organic solvent, although the amount of the polymer-dispersion stabilizing agent is different depending on the kind of polymerizable monomer used for preparing the resin particles.

In the case where the concentration of the polymer-dispersion stabilizing agent is smaller than the above range, polymer particles with a comparatively large particle size can be obtained. On the other hand, when the concentration of the polymer-dispersion stabilizing agent is higher than the above range, polymer particles having a small particle size can be obtained. However, there is little effect for reducing the particle size even when the concentration of the polymer-dispersion stabilizing agent exceeds 10 wt. %.

The above-mentioned polymer-dispersion stabilizing agents are necessary for the preparation of the seed polymer particles, and optionally the inorganic finely-divided particles, pigments, and the surface active agents may be used. The polymer-dispersion stabilizing agents, the inorganic finely-divided particles, pigments, and the surface active agents may also be used together with a solution of a vinyl monomer or a dispersion of seed polymer particles for preventing the aggregation of the polymer particles when the polymer particles are prepared by polymerization.

The polymer particles formed at the initial stage of polymerization are stabilized by the polymer-dispersion stabilizing agent with an equilibrium reached between the hydrophilic organic solvent and the surface of the polymer particles. However, when a large amount of an unreacted monomer remains in the hydrophilic organic solvent, the polymer particles slightly swell and have a viscosity, the so that the polymer particles overcome the steric repulsion of the polymer-dispersion stabilizing agent and eventually aggregate.

When the amount of the monomer is extremely larger than the amount of the hydrophilic organic solvent, the formed polymer particles are completely dissolved in the monomer, so that the polymer particles do not separate out before the polymerization has proceed to a certain extent. In this case, the polymer particles separate out in the form of a tacky mass.

Accordingly, the ratio of the amount of the monomer to the amount of the hydrophilic organic solvent when the polymer particles are produced is approximately 1 or less, preferably ½ or less, although the ratio is different depending upon the kind of hydrophilic organic solvent employed.

The following monomers are soluble in the previously mentioned hydrophilic organic solvents and can be employed for preparing the polymer particles in the present invention: styrene, styrene derivatives such as o-methylstyrene, m-methylstyrene, p-methylstyrene, u-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene; α-methylene aliphatic monocarboxylic acid esters such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, and diethylaminoethyl methacrylate; acrylic acid derivatives and methacrylic acid derivatives such as acrylonitrile, methacrylonitrile, and acrylamide; and halogenated vinyl compounds such as vinyl chloride, vinylidene chloride, vinyl bromide, and vinyl fluoride. These monomers can be used alone or in combination with at least one of the above monomers or with other copolymerizable monomers, with the above monomers being in an amount of 50 wt. % or more when used in the form of a mixture.

The polymer particles for use in the present invention may also be obtained by polymerizing any of the above monomers in the presence of a crosslinking agent which has a two or more polymerizable double-bounds. In this case, the anti-offset properties of the obtained toner particles can be improved.

Examples of preferable crosslinking agents for use in the present invention are all divinyl compounds and compounds having three or more vinyl groups, for example, divinylbenzene, divinylnaphthalene, and derivatives thereof, such as aromatic divinyl compounds; diethylenic carbonic acid esters such as ethylene glycol dimethacrylate, diethylene glycol methacrylate, triethylene glycol methacrylate, trimethylol propane triacrylate, acrylmethacrylate, tert-butylaminoethyl methacrylate, tetraethylene glycol methacrylate, and 1,3-butanediol dimethacrylate; N,N-divinyl aniline; divinyl ether; divinyl sulfide; and divinyl sulfone. These crosslinking agents can be used alone or in combination.

When polymer particles are prepared in a growth polymerization using crosslinked seed polymer particles, followed by the crosslinked seed polymer particles using any of the above crosslinking agents, the inside of each of the polymer particles is crosslinked. When any of the above crosslinking agents is added to a solution of a vinyl monomer for preparation of the polymer particles in a growth polymerization, polymer polymer particles with cured surfaces are formed.

The polymerization may also be performed in the presence of a chain transfer agent which is a compound having a large chain transfer constant in order to adjust the average molecular weight of the polymer particles. Examples of such a chain transfer agent are low-molecular-weight compounds having mercapto groups, carbon tetrachloride and carbon tetrabromide.

Examples of a polymerization initiator used for polymerization of the above-mentioned monomers include, for example, azo-type polymerization initiators such as 2,2'-azobisisobutyronitrile, 2,2'-azobis[2,4-dimethylvaleronitrile); peroxide-type polymerization initiators such as lauryl peroxide, benzoyl peroxide, and tert-butyl peroctoate; persulfide-type polymerization initiators such as potassium persulfate. Sodium thiosulfate and amine may be used in combination of the persulfide-type polymerization initiators.

It is preferable that the ratio of the amount of the polymerization initiator to the amount of the vinyl monomer be in the range of [0.1:100) to [10:100) on a part-by-weight basis.

The polymerization conditions for obtaining the polymer particles are determined by the concentrations and the mixing ratios of the polymer-dispersion stabilizing agent and the vinyl monomer in the hydrophilic organic solvent in accordance with the desired average particle size and particle size distribution of the polymer particles to be obtained.

Generally, the concentration of the polymer-dispersion stabilizing agent is set high to obtain polymer particles with a small average particle size, and is set low to obtain particles with a large average particle size. The concentration of the vinyl monomer is set low to produce polymer particles with an extremely sharp particle size distribution, and is set high to produce polymer particles with a comparatively wide particle size distribution.

The polymer particles are prepared by a method comprising the following steps: (1) completely dissolving the polymer-dispersion stabilizing agent in the hydrophilic organic solvent placed in a reaction vessel; (2) adding at least one vinyl monomer, a polymerization initiator, and if necessary, finely-divided inorganic particles, a surface active agent, a dye and a pigment to the above mixture; (3) stirring the mixture at an ordinary revolution rate of 30 to 300 rpm, more preferably at a lower revolution rate in the above range to make a uniform flow in the vessel, using an agitator of a Turbine agitator, which is more suitable in this case than a Puddle agitator, with application of heat to the reaction mixture to an appropriate temperature suitable for the decomposition rate of the polymerization initiator, thus, the polymerization of the vinyl monomer is accomplished.

Since the temperature at the initial polymerization stage has a significant effect on the particle size of the polymer particles to be obtained, it is preferable that temperature of the above-mentioned mixture be increased to the polymerization temperature after adding the monomer thereto, and that the polymerization initiator, dissolved in a small amount of a solvent, be added to the reaction mixture.

Further, it is necessary to purge oxygen from the reaction vessel with an inert gas such as nitrogen or argon at the polymerization. In the case where oxygen is not sufficiently purged, the polymerization of the vinyl monomer is such that the polymer particles having the desired average particle size with the desired particle size distribution cannot always be obtained.

A polymerization time period of 5 to 40 hours will be necessary to produce the polymer particles for use in the present invention, but the particle sizes and particle size distribution of the polymer particles to be produced can be adjusted as desired by terminating the polymerization reaction or by increasing the polymerization reaction rate by successively adding a polymerization initiator to the reaction mixture or conducting the polymerization under high pressure.

The thus obtained polymer particles may be directly dyed, or subjected to a separation process, such as settling separation, centrifugation or decantation, to remove unnecessary polymer particles, the remaining monomer, and the polymer-dispersion stabilizing agent therefrom, followed by the steps of recovering the polymer particles in the form of a polymer slurry and then dyeing the same.

In the dyeing process, it is better not to remove the polymer-dispersion stabilizing agent because a dyeing system including the polymer-dispersion stabilizing agent is more stable than a dyeing system free from the polymer-dispersion stabilizing agent and unnecessary aggregation of the polymer particles can be avoided.

The dyeing process for the present invention is carried out as follows:

Polymer particles are dispersed in an organic solvent in which the polymer particles are insoluble. Before or after dispersing the polymer particles in the organic solvent, a dye is dissolved in the organic solvent. Thus the dye is caused to penetrate into the polymer particles, and the polymer particles are dyed. The organic solvent is then removed from the above mixture to obtain dyed toner particles. The dye employed in this dyeing method has a solubility $[D_1]$ in the organic solvent and a solubility $[D_2]$ in the polymer particles, with the solubility $[D_1]$ and the solubility $[D_2]$ preferably being in the relationship of $[D_1]/[D_2] \leqq 0.5$, more preferably in the relationship of $[D_1]/[D_2] \leqq 0.2$. By use of this dye, the polymer particles can be sufficiently dyed deep into the inside thereof. The above-mentioned solubilities $[D_1]$ and $[D_2]$ are at 25° C.

The solubility $[D_2]$ of the dye in the polymer particles is finely-divided particles in the same manner as with the solubility $[D_1]$ of the dye in the organic solvent, that is, by the maximum amount of the dye that can be contained in a compatible manner in the polymer particles.

The state in which the dye is dissolved in the polymer particles and the state in which the dye is separated from the polymer particles can be easily observed by using a microscope.

The solubility of the dye in the polymer particles can also be observed by an indirect observation method instead of the above-mentioned direct observation method. In the indirect observation method, a liquid having a solubility coefficient which is very close to the the solubility of the polymer particles, that is, a liquid in which the polymer particles are very soluble, is employed, so that the solubility of the dye in the solvent may be defined as the solubility of the dye in the polymer particles.

As dyes for use in the present invention, any dyes can be employed as long as the above mentioned solubility relationship can be met. In general, water-soluble dyes such as cationic dyes and anionic dyes are not suitable for use in the present invention because the properties thereof are significantly changeable depending upon the ambient conditions and when they are used in the toner, the resistivity of the toner tends to be decreased and therefore the image transfer ratio tends to be decreased. For this reason, vat dyes, disperse dyes, and oil-soluble dyes are preferable for use in the present invention. In particular, oil-soluble dyes are most suitable for use in the present invention.

Furthermore, several dyes can be used in combination for obtaining a desired color tone. The weight ratio of the dye to the polymer particles to be dyed can be selected depending upon the desired color tone. However, generally, it is preferable that the amount of the dye be in the range of 1 to 50 parts by weight to 100 parts by weight of the resin particles to be dyed.

In the present invention, when an alcohol having a relatively high SP (Solubility Parameter) value, such as methanol or ethanol, is employed as a solvent for dyeing and a styrene-acrylic resin having a SP value of about 9 is used as the material for the polymer particles, for example, the following dyes can be employed:

C.I. Solvent Yellow (6, 9, 17, 31, 35, 100, 102, 103, 105),
C.I. Solvent Orange (2, 7, 13, 14, 66),
C.I. Solvent Red (5, 16, 17, 18, 19, 22, 23, 143, 145, 146, 149, 150, 151, 157, 158),
C.I. Solvent Violet (31, 32, 33, 37),
C.I. Solvent Blue (22, 63, 78, 83–86, 91, 94, 95, 104),
C.I. Solvent Green (24, 25), and
C.I. Solvent Brown (3, 9).

In addition, the following commercially available dyes can be employed:

Aizen Sot dyes such as Yellow-1, 3, 4, Orange-1, 2, 3, Scarlet-1, Red-1, 2, 3, Brown-2, Blue-1, 2, Violet-1, Green-1, 2, 3, and Black-1, 4, 6, 8 (made by Hodogaya Chemical Co., Ltd.); Sudan dyes such as Yellow-140, 150, Orange-220, Red-290, 380, 460, and Blue-670 (made by BASF Japan Ltd.); Diaresin, Yellow-3G, F, H2G, HG, HC, HL, Orange-HS, G, Red-GG, S, HS, A, K, H5B, Violet-D, Blue-J, G, N, K, P, H3G, 4G, Green-C, and Brown-A (made by Mitsubishi Chemical Industries, Ltd.); Oil Color, Yellow-3G, GG-S, #105, Orange-PS, PR, #201, Scarlet-#308, Red-5B, Brown-GR, #416, Green-BG, #502, Blue-BOS, IIN, and Black-HBB, #803, EE, EX (Orient Chemical Industries, Ltd.); Sumiplast, Blue GP, OR, Red FB, 3B, and Yellow FL7G, GC (made by Sumitomo Chemical Co., Ltd.); Kayaron, Polyester Black EX-SH300, and Blue A-2R of Kayaset Red-B (made by Nippon Kayaku Co., Ltd.).

The applicable dyes are not limited to the above since the dyes are appropriately selected under consideration of the combination with the polymer particles and the solvent used in the dyeing process.

As the organic solvents for dyeing the polymer particles with any of the above dyes, it is preferable to employ solvents in which the polymer particles are not dissolved, or in which the polymer particles slightly swell with the solvents. More specifically it is preferable that the difference between the SP value of the solvents and that of the polymer particles be 1.0 or more, more preferably 2.0 or more. For example, it is preferable to employ an alcohol having a high SP value such as methanol, ethanol or n-propanol, or an organic solvent having a low SP value such as n-hexane or n-heptane in combination with styrene-acrylic polymer particles.

However, when the difference in the SP value between the organic solvent and the polymer particles is too large, the wetting of the polymer particles with the solvent is so poor that the polymer particles are not appropriately dispersed in the organic solvent. Therefore, it is preferable that the SP value difference be in the range of 2 to 5.

In the present invention, the dyeing is carried out, for example, by dispersing the polymer particles in the above-mentioned organic solvent in which an appropriate dye is dissolved, and stirring the dispersion under the conditions that the temperature of the dispersion is kept at the temperature below the glass transition temperature of the resin, whereby the penetrating rate of the dye into the polymer particles can be increased and sufficiently dyed polymer particles can be obtained in about 30 minutes to about one hour. For stirring the dispersion of the dye and polymer particles, commercially available stirrers such as homomixer and magnetic stirrer can be employed.

Alternatively, the dyed polymer particles can be obtained by directly adding the dye to a slurry comprising an organic solvent and the polymer particles which are dispersed in the organic solvent, which is obtained, for example, at the completion of a dispersion polymerization process, and stirring the mixture under the above-mentioned conditions with the application of heat thereto. When the temperature at which the polymer particles and the dye-containing solvent are mixed and stirred is above the glass transition temperature of the polymer particles, the polymer particles tend to aggregate during the stirring step.

As drying method for the slurry after the completion of the dyeing any method can be employed. For example, dyed polymer particles are separated from the slurry by filtration under reduced pressure. Alternatively, dyed polymer particles can be obtained by directly drying the slurry under reduced pressure, without filtration.

The dyed polymer particles obtained by filtration followed by the air-drying or drying under reduced pressure do not aggregate and have substantially the same particle size distribution as that of the polymer particles prior to the dyeing process.

In the present invention, in order to improve the triboelectric charging characteristics of the toner particles prepared through the above-mentioned dyeing process, charge control agents can be contained in the toner particles by the following methods: for example, (1) to dissolve a charge control agent together with the dye in the organic solvent in the course of dyeing step of the polymer particles. With this method the charge control agent is caused to stay on the surface of the toner particles after excluding the organic solvent. (2) to mechanically fix the charge control agent to the surface of the dried polymer particles after dyeing. This method is called mechanical disposition method. When necessary, thermal energy can be supplementally applied to the particles. In this case the charge control agent, preferably with a particle diameter of 1 μm or less is strongly fixed to the surface of the toner particles to such a fixing degree that the charge control agent does not easily come off the toner particles in developers.

Moreover, the amount ratio of the charge control agent to the dyed polymer particle can be appropriately selected since the quantity of the electric charge required to toner particles varies depending on the development means.

Generally, it is preferable that the amount ratio of the charge control agent be 0.1 to 50 parts by weight to 100 parts by weight of the dyed polymer particles. When the amount ratio of the charge control agent is less than 0.1 parts by weight, the effect to control the quantity of electric charge is too small, and on the other hand, when the amount ratio of the charge control agent is more than 50 parts by weight there is bad effect on the image fixing properties.

As a method of containing the charge control agents to the toner particles, the dyed polymer particles and the charge control agents are mixed, and then the mechanical energy is applied to the mixture. Any mixing apparatus such as a ball mill, V-blender, or Henshel Mixer can be employed for mixing the charge control agent and the toner particles. Mechanical energy can be applied, for instance, by rotating the mixture with rotary blades which are rotated at high speed to imparting impact to the mixture, or by causing the charge control agent particles to collide with the toner particles within a stream of air which flows at high speed, or by causing both particles to collide with a collision plate in such an air stream, whereby the charge control agent is firmly fixed to the surface of the toner particles.

As commercially available apparatus for the above purpose of applying such mechanical energy, for example, apparatus named "Angmill" (made by Hosokawa Micron Corporation) and "Super Sonic Jet Mill (impact mill)" made by Nippon Pneumatic Mfg. Co., Ltd.), crushing mills which are modified so as to reduce crushing air pressure as compared with that of an ordinary crushing mill, an apparatus named "Hybridization System" (made by Nara Kikai Seisakusho Co., Ltd.) and an automatic mortar can be employed.

Representative examples of the charge control agent for use in the present invention are as follows: nigrosine, azine dyes with an alkyl group having 2 to 16 carbon atoms, disclosed in Japanese Patent Publication No. 42-1627 basic dyes such as C.I. Basic Yellow 2 (C.I. 41000), C.I. Basic Yellow 3, C.I. Basic Red (C.I. 45160), C.I. Basic Red 9 (C.I. 42500), C.I. Basic Violet 1 (C.I.42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green (C.I. 42040), C.I. Basic Green 4 (C.I. 42000), lake pigments of the above basic dyes which are prepared by using a lake formation agent (for example, phosphotungstic acid, phosphomolybdic acid, phosphotungsto-molybdic acid, tannic acid, lauric acid, ferricyanic compounds, or ferrocyanic compounds), C.I. Solvent Black 3 (C.I. 26150), Hansa Yellow G (C.I. 11680), C.I. Mordlant Black 11, C.I. Pigment Black 1, benzomethylhexadecylammonium chloride, decyl-trimethyl-ammonium chloride, dialkyl tin compounds such as dibutyl tin and dioctyl tin compounds, dialkyl tin borate compounds, guanidine derivatives, polyamine resins such as amino-group-containing vinyl polymers and amino-group-containing condensation polymers, metal complex salts of monoazo dyes described in Japanese Patent Publications Nos. 41-20153, 43-27596, 44-6397, and 45-26478, metal complexes such as Zn, Al, Co, Cr and Fe complexes of salicylic acid, dialkyl salicylic acid, naphthoic acid and dicarboxylic acids, and sulfonated copper phthalocyanine pigments.

In the present invention, the following finely-divided particles which are prepared by, for instance, recrystalization, grinding, or emulsification, can be mechanically deposited on the surface of the polymer particles in the same manner as with the charge control agents: finely-divided particles with comparatively high glass transition temperature (Tg), for example, submicron particles of PMAA (polymethyl methacrylate), PTFE (polytetrafluoroethylene) and PVDF (polyvinylidene fluoride); and lubricants such as polyolefin, fatty acid esters, metal salts of aliphatic acids, higher alcohols, and paraffin wax.

The above particles can be deposited on the polymer particles at the same time as with the deposition of the charge control agents or separately deposited thereon before or after the deposition of the charge control agent.

In the present invention, a fluidity improvement agent can be employed, which is used by mixing with the toner particles and causing the agent to adhere to the surfaces of the toner particles to improve the fluidity of the toner particles. Representative examples of such a fluidity improvement agent are conventional finely-divided particles of titanium oxide, hydrophobic silica, zinc stearate, and magnesium stearate.

Such a fluidity improvement agent is mixed with the toner particles in a conventional mixing apparatus such as V-blender or a ball mill.

The features of the present invention will become apparent in the course of the following description of explanatory embodiments, which are given for illustration of the invention and are not intended to be limiting thereof.

EXAMPLE 1

Preparation of Core Particles 320 g of methanol was placed in a 500-ml three-necked flask fitted with a mechanical stirrer and a cooler. 6.4 g of polyvinyl pyrrolidone (average molecular weight of 40,000) serving as a polymer-dispersion stabilizing agent was gradually added to the methanol with stirring, so that the polyvinyl pyrrolidone was completely dissolved in the methanol. A mixture of the following components was added to this solution and completely dissolved therein:

| | |
|---|---|
| Styrene | 25.6 g |
| n-butyl-methacrylate | 6.4 g |
| 2,2'-azobisisobutylonitrile | 0.2 g |

The thus obtained solution was stirred with a stream of nitrogen gas being passed through the flask to displace the air with the nitrogen gas and then allowed to stand for 1 hour.

The above reaction mixture was then heated to a temperature of 60° C.±0.1° C., with stirring at 200 rpm, by holding the flask in a constant temperature water bath maintained in the above temperature range, so that a polymerization reaction was initiated. About 15 minutes after the heat elevation, the reaction mixture began to become milky white in color. Thus, the polymerization was continued for 20 hours. At this stage, the reaction mixture was a stable milky white dispersion. An analysis of the reaction mixture by gas chromatography as the internal standard indicated that the polymerization degree reached 92%.

The thus obtained dispersion was cooled and centrifuged at 2000 rpm using a centrifugal separator. As a result, polymerized particles were completely precipitated and the supernatant solution was clear. The supernatant solution was removed and 200 g of methanol was added to the precipitated polymer particles. The mixture was stirred for 1 hour and the polymerized particles were washed with the methanol. The polymerized particles were again centrifuged under the same conditions as mentioned above. Finally the polymerized particles are filtered off.

The polymerized particles were dried under reduced pressure at 50° C. for 24 hours, whereby styrene - n-butylmethacrylate copolymer particles which are herein after referred to as polymer particles B, were obtained in the form of white powder in a yield of 95%.

The thus obtained polymerized particles B, serving as core particles for toner particles, have Dv of 7.40 μm, and Dv/Dp of 1.07. So that the average particle size is calculated to be 6.92 μm. Further the glass transition temperature (Tg) of the polymer particles was 65° C.

Preparation of Dyed Polymer Particles 1.50 g of Oil Black 803 (made by Orient Chemical Industries, Ltd.) was dissolved in 200 g of methanol with the application of heat thereto. The thus obtained solution was cooled and then drawn through a 1 μm-filter to obtain a filtrate containing the dye.

24 g of the above prepared polymer particles B was added to the filtrate and the mixture was heated with stirring at 50° C. for one hour, and then cooled to room temperature, whereby a dispersion of the polymer particles B was obtained. The dispersion was cooled to the room temperature and filtered off, and dried at 50 ° C.

for 24 hours under reduced pressure, whereby dyed polymer particles B were obtained.

Then, 100 parts by weight of the dyed polymer particles B and 3 parts by weight of zinc 3,5-di-t-butylsalicylate serving as a charge control agent were mixed and stirred in a mixer for 10 minutes and the mixture was subjected to a mechanical charge control agent deposition treatment for depositing the charge control agent on the surface of the dyed polymer particles, with the mixture being rotated at 7000 rpm for 10 minutes, by an apparatus named "Hybridization NHS-1" made by Nara Kikai Seisakusho Co., Ltd.) to obtain a mixture.

To 100 parts by weight of the thus obtained mixture, 0.75 parts by weight of hydrophobic silica were added and mixed in a Henshel Mixer at 2000 rpm for 10 minutes, whereby toner particles (a) for use in the present invention were prepared.

Preparation of Resin-Coated Carrier Particles

Furthermore, ferrite particles with an average particle size of 100 μm were coated with a silicone resin containing 3.0 wt. % of carbon black ("Ketjen black EC-DJ600" made by Lion Akzo Co., Ltd.) with a thickness of 1 μm, whereby resin-coated carrier particles were obtained. The electric resistivity of the thus obtained resin-coat carrier particles was $3.6\times10^{11}$ cm under application of a DC voltage of 1000 volts.

Preparation of Two-component Developer 100 parts by weight of the carrier particles and 3 parts by weight of the toner particles [a) were mixed, whereby a two-component dry type developer according to the present invention was obtained Copies were made, using this developer, by a commercially available copying machine (Trademark "Imagio 420" made by Ricoh Company, Ltd.). The result was that images with high density and high resolution were obtained, without the occurrence of toner deposition on the background of the images and the formation of non-developed portions at the rear edge of the half-tone image areas in the images. In addition, 20,000 copies were successively made using this developer in the above copying machine. The obtained image quality was high and did not change from the first copy through the last copy.

COMPARATIVE EXAMPLE 1

The procedure for Example 1 was repeated except that the carbon black contained in the silicone resin used for coating the ferrite particles for the carrier particles prepared in Example 1 was eliminated, whereby comparative carrier particles and a comparative two-component dry type developer were prepared The electric resistivity of the comparative carrier particles was $2.5\times10^{16}$ Ωcm under application of a DC voltage of 1000 volts.

Copies were made using the above comparative two-component dry type developer in the same manner as in Example 1. As a result, a non-developed portion with a width of about 2 mm was formed at the rear edge of a half-tone image of each copy.

COMPARATIVE EXAMPLE 2

The procedure for Example 1 was repeated except that the amount of the carbon black contained in the silicone resin used for coating the ferrite particles for the carrier particles in Example 1 was changed to 8.0 wt. %, whereby comparative carrier particles and a comparative two-component dry type developer were prepared.

It was impossible to measure the electric resistivity of the comparative carrier particles because of the occurrence of the dielectric breakdown under application of a voltage of 50 volts or more.

Copies were made using the above comparative two-component dry type developer in the same manner as in Example 1. As a result, although no non-developed portions were formed at the rear edge of a half-tone image of each copy, the carrier particles were deposited on solid image areas and the toner particles were deposited on the background of the images.

COMPARATIVE EXAMPLE 3

The procedure for Example 1 was repeated except that the amount of the carbon black contained in the silicone resin used for coating the ferrite particles for the carrier particles in Example 1 was changed to 5.0 wt. %, whereby comparative carrier particles and a comparative two-component dry type developer were prepared.

The electric resistivity of the comparative carrier was $1.9\times10^{7}$ Ωcm under application of a DC voltage of 1000 volts.

Copies were made using the above comparative two-component dry type developer in the same manner as in Example 1. As a result, although no non-developed portions were formed at the rear edge of a half-tone image of each copy, the toner particles were deposited on the background of the images.

EXAMPLE 2

The procedure for Example 1 was repeated except that the carrier particles prepared in Example 1 were replaced by carrier particles prepared by coating ferrite particles with an average particle size of 100 μm with polymethyl methacrylate with a thickness of 0.12 μm, whereby a two-component dry type developer according to the present invention was prepared.

The electric resistivity of the carrier particles was $3.5\times10^{12}$ Ωcm under application of a DC voltage of 1000 volts.

Copies were made using the above two-component dry type developer in the same manner as in Example 1. As a result, high quality images without problems of the deposition of the toner particles on the images, the formation of non-developed portions at the rear edge of the half-tone image, and the deposition of the carrier particles on the solid image areas.

COMPARATIVE EXAMPLE 4

The procedure for Example 2 was repeated except that the thickness of the polymethyl methacrylate with which the ferrite particles for the carrier particles in Example 2 was changed to 0.8 μm, whereby a comparative two-component dry type developer were prepared.

The electric resistivity of the comparative carrier particles was $6.4\times10^{14}$ Ωcm under application of a DC voltage of 1000 volts.

Copies were made using the above comparative two-component dry type developer in the same manner as in Example 1. As a result, a non-developed portion with a width of about 2.5 mm was formed at the rear edge of a half-tone image of each copy, although the toner particles were not deposited on the background of the images and the carrier particles were not deposited on the solid image areas.

The initial properties of the developers prepared in Examples 1 and 2 according to the present invention and comparative developers prepared in Comparative Examples 1 to 4, and the properties thereof after used in making 20,000 copies in Tables 1 and 2.

TABLE 1

| | Initial Properties of Developers | | | | | | |
|---|---|---|---|---|---|---|---|
| | Electric Resisitivity of Carrier Particles (Ωcm) | Q/M (μC/g) | Image Density | Toner Deposition on Background | Resolution (lines/mm) | Formation of Non-printing portions | Deposition of Carrier Particles |
| Example 1 | $3.6 \times 10^{11}$ | −27.1 | 1.48 | none | 15.7 | none | none |
| Comp. Example 1 | $2.5 \times 10^{16}$ | −28.9 | 1.47 | none | 15.7 | observed | none |
| Comp. Example 2 | (note 1) | −16.5 | 1.50 | observed | 11.8 | none | observed |
| Comp. Example 3 | $1.9 \times 10^{7}$ | −18.2 | 1.51 | observed | 11.8 | none | none |
| Example 2 | $3.5 \times 10^{12}$ | −22.3 | 1.49 | none | 15.7 | none | none |
| Comp. Example 4 | $6.4 \times 10^{14}$ | −24.9 | 1.48 | none | 15.7 | observed | none |

(note 1)
A dielectric breakdown occurred under application of a voltage of 50 V or more

TABLE 2

| | Properties of Developers After Making 20,000 Copies | | | | | |
|---|---|---|---|---|---|---|
| | Q/M (μC/g) | Image Density | Toner Deposition on Background | Resolution (lines/mm) | Formation of Non-printing portions | Deposition of Carrier Particles |
| Example 1 | −24.8 | 1.48 | none | 15.7 | none | none |
| Comp. Example 1 | −26.5 | 1.48 | none | 15.7 | observed | none |
| Comp. Example 2 | −12.0 | 1.53 | observed | 7.9 | none | observed |
| Comp. Example 3 | −14.3 | 1.52 | observed | 9.8 | none | none |
| Example 2 | −20.1 | 1.49 | none | 15.7 | none | none |
| Comp. Example 4 | −21.8 | 1.49 | none | 15.7 | observed | none |

(note 1)
A dielectric breakdown occurred under application of a voltage of 50 V or more The developers according to the present invention are capable of providing high quality images with high resolution, free from problems such as toner particle deposition on the background of the images, the formation of non-developed portions at the rear edge of a half-tone image area, and can be used for an extended period of time, without changes in the physical properties and the development characteristics thereof.

What is claimed is:

1. A dry type developer comprising:
(a) substantially spherical, electrically insulating toner particles which are dyed polymer particles, free from electro-conductive particles, prepared by dyeing polymer particles with a dye by dispersing said polymer particles in an organic solvent in which said polymer particles are insoluble; and
(b) carrier particles, each carrier particle comprising a core particle and a resin layer comprising an electroconductive material coated on the surface of said core particle, with a resistivity in the range of $10^8$ to $10^{14}$ Ωcm under the application of a DC voltage of 1000 volts.

2. The dry type developer as claimed in claim 1, wherein said carrier particles have a resistivity in the range of 10 to $10^{13}$ Ωcm under application of a DC voltage of 1000 volts.

3. The dry type developer as claimed in claim 1, wherein said core particles comprise a magnetic material selected from the group consisting of $Fe_2O_3$, γ-$Fe_2O_3$, $Fe_3O_4$, MnZn ferrite, NiZn ferrite, Ba ferrite, Fe, Ni, Co and alloys thereof.

4. The dry type developer as claimed in claim 1, wherein said core particles comprise a glass bead.

5. The dry type developer as claimed in claim 1, wherein said resin layer coated on said carrier particles comprises a resin selected from the group consisting of polyolefin resin, polyvinyl resin, polyvinylidene resin, vinyl chloride - vinyl acetate copolymer, silicone resin, modified silicone resin, fluorocarbon resin, polyamide, polyester, polyurethane, polycarbonate, amino resin, and epoxy resin.

6. The dry type developer as claimed in claim 1, wherein said toner particles have a volume mean diameter Dv and a particle number mean diameter Dp in the relationship: $1.00 \leqq Dv/Dp \leqq 1.20$.

7. The dry type developer as claimed in claim 6, wherein Dv is in the range of 1 μm to 10 μm.

8. The dry type developer as claimed in claim 1, wherein said polymer particles are prepared by a dispersion polymerization.

9. The dry type developer as claimed in claim 8, wherein said dispersion polymerization is conducted by adding at least one vinyl monomer to a hydrophilic organic solvent in which said vinyl monomer is soluble, but said polymer particles swell or substantially insoluble, with addition thereto of a polymer-dispersion stabilizing agent which is soluble in said hydrophilic organic solvent.

10. The dry type developer as claimed in claim 1, wherein said toner particles further comprises a charge control agent which is deposited on the surface of each of said toner particles.

11. The dry type developer as claimed in claim 10, wherein said charge control agent is deposited on said polymer particles by mixing said charge control agent and said polymer particles with application of mechanical energy thereto.

12. The dry type developer as claimed in claim 1, wherein said toner particles further comprises a release agent which is deposited on the surface of each of said toner particles.

13. The dry type developer as claimed in claim 1, wherein said toner particles further comprise a charge control agent and a release agent which are deposited on the surface of each of said toner particles.

14. The dry type developer as claimed in claim 13, wherein said charge control agent and said release agent which are simultaneously or separately deposited on the surface of each of said toner particles by mixing said charge control agent, said release agent, and said polymer particles with application of mechanical energy thereto.

15. The dry type developer as claimed in claim 1, further comprising finely-divided particles of a fluidity-providing agent which provides fluidity to said toner particles.

* * * * *